US006304067B1

(12) United States Patent
Wrathall

(10) Patent No.: US 6,304,067 B1
(45) Date of Patent: Oct. 16, 2001

(54) ADDING A LAPLACE TRANSFORM ZERO TO A LINEAR INTEGRATED CIRCUIT FOR FREQUENCY STABILITY

(75) Inventor: Robert S. Wrathall, Scotts Valley, CA (US)

(73) Assignee: Micrel, Incorporated, San Jose, CA (US)

( * ) Notice: Subject to any disclaimer, the term of this patent is extended or adjusted under 35 U.S.C. 154(b) by 0 days.

(21) Appl. No.: 09/733,863

(22) Filed: Dec. 8, 2000

(51) Int. Cl.[7] ..... G05F 1/40
(52) U.S. Cl. ..... 323/282; 323/285
(58) Field of Search ..... 323/222, 266, 323/271, 273, 282, 285, 286

(56) References Cited

U.S. PATENT DOCUMENTS 5,382,918 1/1995 Yamatake ..... 330/260
5,514,947 5/1996 Berg ..... 323/282
5,770,940 * 6/1998 Goder ..... 323/282
5,889,393 * 3/1999 Wrathall ..... 323/282
5,894,243 * 4/1999 Hwang ..... 327/540
6,150,804 * 11/2000 Taghizadeh-Kaschani ..... 323/285

* cited by examiner

*Primary Examiner*—Matthew Nguyen
(74) *Attorney, Agent, or Firm*—Skjerven Morrill MacPherson LLP; Carmen C. Cook

(57) ABSTRACT

A compensation circuit for introducing a zero in a first circuit being incorporated in a closed loop feedback system includes a first capacitor, an amplifier and a second capacitor, connected in series between a feedback terminal and an input node of the first circuit. A first resistor is coupled between the feedback terminal and the input node to provide a resistive load to the compensation circuit. The amplifier amplifies the capacitance of the second capacitor to introduce a zero in the first circuit having effectiveness over a wide frequency range. In one embodiment, the compensation circuit is applied to a switching regulator controller for adding an effective zero in the feedback system of a switching regulator for compensating a double-pole introduced by a LC filter circuit in the switching regulator feedback system.

28 Claims, 3 Drawing Sheets

ADDING A LAPLACE TRANSFORM ZERO TO A LINEAR INTEGRATED CIRCUIT FOR FREQUENCY STABILITY

BACKGROUND OF THE INVENTION

1. Field of the Invention

The invention relates to a circuit and method for adding a Laplace transform zero to a linear integrated circuit, and more particularly to a circuit and method for adding a Laplace transform zero in a switching regulator feedback loop for providing frequency stability.

2. Description of the Related Art

Closed loop negative feedback systems are commonly employed in linear integrated circuits. For instance, switching regulators use a feedback loop to monitor the output voltage in order to provide regulation. To ensure stability in any closed loop system, the Nyquist criterion must be met. The Nyquist criterion states that a closed loop system is stable if the phase shift around the loop is less than 180 degrees at unity gain. Typically, a compensation circuit is added to a feedback loop to modulate the phase shift of the feedback loop to obtain stability.

The frequency response of a linear circuit can be characterized by the presence of "poles" and "zeros". A "pole" is a mathematical term which signifies the complex frequency at which gain reduction begins. On the other hand, a "zero" signifies the complex frequency at which gain increase starts. Poles and zeros on the left half plane of a complex frequency plane or s-plane are considered normal and can be compensated. However, poles and zeros on the right half plane of a complex frequency plane are usually problematic and difficult to manipulate and is not addressed in the present application. Generally, a pole contributes a −90° phase shift while a zero contributes a +90° phase shift. A pole cancels out the phase shift of a zero for zeros in the left half plane. In designing a closed loop system with compensation, the location of the poles and zeros are manipulated so as to avoid a greater than 180° phase shift at unity gain.

In a linear circuit, poles are created by placing a small capacitor on a node with a high dynamic impedance. If the capacitor is placed at a gain stage, the capacitance can be multiplied by the gain of the stage to increase its effectiveness. Each pole has a zero associated with it. That is, at some point, the dynamic resistance of the gain stage will limit the gain loss capable of being achieved by the capacitor. Thus, a zero can be created by placing a resistor in series with the gain reduction capacitor.

A conventional voltage mode switching regulator uses an inductor-capacitor (LC) network at the voltage output terminal for filtering the regulated output voltage to produce a relatively constant DC output voltage. FIG. 1 is a schematic diagram of a conventional switching regulator including a switching regulator controller 10 and an LC circuit 11. Switching regulator controller 10 generates a regulated output voltage $V_{sw}$ at an output terminal 13 which is coupled to LC circuit 11 for providing a filtered output voltage $V_{OUT}$. The output voltage $V_{OUT}$ is coupled back to controller 10 at a feedback (FB) terminal 15 for forming a feedback control loop. The LC circuit has associated with it two poles, one pole associated with each element. If the feedback control loop is not compensated, LC circuit 11 alone contributes an −180°. phase shift to the system and loop instability results, causing the output voltage to oscillate. Because virtually every switching regulator uses an LC filter circuit to filter the regulated output voltage, compensation must be provided in the feedback control loop of a switching regulator to compensate for the effect of the two poles introduced by the LC circuit.

A conventional compensation technique in switching regulators involves adding a circuit in series with the feedback loop which produces a Laplace zero. The zero is added to the feedback control loop to cancel out one of the two poles of the LC filter circuit, thus insuring closed loop stability. U.S. Pat. No. 5,382,918 to Yamatake describes using a capacitance multiplying op-amp to provide a large effective capacitance and a resistor in series as the frequency compensation element of a switching regulator. U.S. Pat. No. 5,514,947 to Berg describes a phase lead compensation circuit for providing additional phase to the loop gain of a switching regulator near the unity gain frequency. The phase lead compensation circuit of Berg uses a transconductance amplifier driving a frequency-dependent load, implemented as a band-limited op amp, in the feedback control loop of the switching regulator. These approaches are problematic because they both require a "high quality" differential amplifier in operation which are significantly large and complex to realize. In practice, differential amplifiers are typically large devices and can be relatively slow. Furthermore, the differential amplifiers tend to sink large amounts of current proportional to speed. The compensation approaches described by Yamatake and Berg are undesirable because the compensation techniques require sacrificing speed for closed loop stability. In addition the op-amp used in the compensation circuit needs to be compensated for stability itself, making the circuit more complex to implement.

FIG. 1 illustrates another approach for providing compensation in a feedback control loop of a switching regulator. Referring to FIG. 1, the output voltage $V_{OUT}$ is coupled to the feedback terminal 15 and further to a voltage divider including resistors $R_1$ and $R_2$. The operation of the feedback control loop in controller 10 is well known in the art. The voltage divider steps down output voltage $V_{OUT}$ and the divided voltage $V_R$ is coupled to an error amplifier 20 which compares the divided voltage $V_R$ to a reference voltage $V_{Ref}$. Error amplifier 20 generates an error output signal indicative of the difference between voltage $V_R$ and reference voltage $V_{Ref}$. The feedback control loop of controller 10 operates to regulate the output voltage $V_{OUT}$ based on the error output of error amplifier 20 so that voltage $V_R$ equals voltage $V_{Ref}$.

FIG. 2*a* is a plot of the loop gain magnitude vs. frequency in log scale for the switching regulator of FIG. 1 without any compensation. The low frequency loop gain is first reduced by a pole associated with error amplifier 20. The gain loss is modified by a zero also associated with the error amplifier. Then, at high frequency, the effect of the double-pole in the LC filter circuit causes a large loss in the loop gain such that the phase shift at unity gain is equal to or greater than 180°. The feedback control loop of the uncompensated switching regulator of FIG. 1 is unstable unless the gain is substantially reduced.

In the switching regulator of FIG. 1, a capacitor 18 (typically referred to as a "zero capacitor") is connected in parallel to resistor $R_1$ of the voltage divider.

Capacitor 18 introduces a zero-pole pair in the feedback loop. The location (or frequency) of the zero-pole pair is determined by the resistance of the voltage divider and the capacitance of capacitor 18. For practical resistance and capacitance values, the zero and pole introduced by capacitor 18 are typically located close to each other so that the zero is canceled out quickly by the nearby associated pole. FIG. 2*b* is a plot of the loop gain magnitude vs. frequency in log scale in the switching regulator of FIG. 1 incorporating zero capacitor 18. Here, the operation of the zero capacitor ensures that the phase shift is less than 180° near unity gain. However, the compensation provided by zero capacitor 18 is limited and often does not provide sufficient phase margin at unity gain. For example, at high frequency, zero capacitor 18 shorts out resistor $R_1$, resulting in no or minimal gain loss in the feedback loop. Thus, the compensation provided by capacitor 18 is not effective at high frequency. Also, the voltage divider of resistors $R_1$ and $R_2$ typically provides only a gain loss of 3 dB. The 3 dB gain loss limits the ratio of the pole to zero angular frequency of capacitor 18, and thus, limits the compensation range capable of being achieved by the use of a single zero capacitor 18. The feedback loop of switching regulator of FIG. 1 is susceptible to instability when the switching regulator is subjected to fluctuations in the load impedance because of this limited compensation range.

Thus, it is desirable to provide a compensation circuit in a feedback loop of a linear circuit which is capable of providing effective pole cancellation.

SUMMARY OF THE INVENTION

According to one embodiment of the present invention, a compensation circuit for introducing a zero in a first circuit being incorporated in a closed loop feedback system is provided. The first circuit includes a first terminal generating a first voltage for the closed loop feedback system and a feedback terminal for receiving a feedback voltage from the closed loop feedback system and coupling the feedback voltage to an input node in the first circuit. The compensation circuit includes a first capacitor, an amplifier and a second capacitor. The first capacitor is coupled between the feedback terminal of the first circuit and a first node. The first capacitor receives the feedback voltage at the feedback terminal and functions to block out the DC component of the feedback voltage. The amplifier is coupled between the first node and a second node. The second capacitor is coupled between the second node and the input node of the first circuit. The compensation circuit further includes a first resistor coupled between the feedback terminal and the input node for providing a resistive load to the compensation circuit.

The compensation circuit amplifies the capacitance of the second capacitor and introduces a zero in the first circuit effective for pole-cancellation in the closed loop feedback system. Furthermore, the zero introduced by the compensation circuit has effectiveness over a wide range of frequencies.

In one embodiment, the compensation circuit of the present invention is applied to a switching regulator controller circuit for providing an effective zero in the feedback loop of a switching regulator. The zero acts to compensate for the effect of the double-pole introduced by the LC filter circuit generally applied to the regulated output voltage of the switching regulator controller circuit.

The present invention is better understood upon consideration of the detailed description below and the accompanying drawings.

BRIEF DESCRIPTION OF THE DRAWINGS

In the present disclosure, like objects which appear in more than one figure are provided with like reference numerals.

DETAILED DESCRIPTION OF THE PREFERRED EMBODIMENTS

In accordance with the present invention, a zero generation circuit for adding a Laplace transform zero in a linear or analog circuit includes a blocking capacitor and an open loop amplifier coupled to a zero capacitor for multiplying the capacitance of the zero capacitor. The zero generation circuit provides a wide band and effective zero for pole cancellation in a linear circuit for obtaining frequency stability. The zero generation circuit of the resent invention has the advantages of consuming a small circuit area and being power efficient, drawing only a small bias current. Furthermore, the zero generation circuit can operate at high frequency to provide compensation for a large frequency range. The zero generation circuit of the present invention can be applied in switching voltage regulators and other closed loop feedback systems with multiple poles for introducing an effective "zero" compensation and improving frequency stability.

In the present description, a "zero" and a "pole" have meanings well understood by one skilled in the art. Specifically, a "zero" refers to the complex frequency at which the frequency response of a linear circuit has a zero amplitude, and a "pole" refers to the complex frequency at which the frequency response of a linear circuit has an infinite amplitude. In a feedback system, a pole signifies the frequency at which gain reduction begins while a zero signifies the frequency at which gain increase starts.

Figure 3:
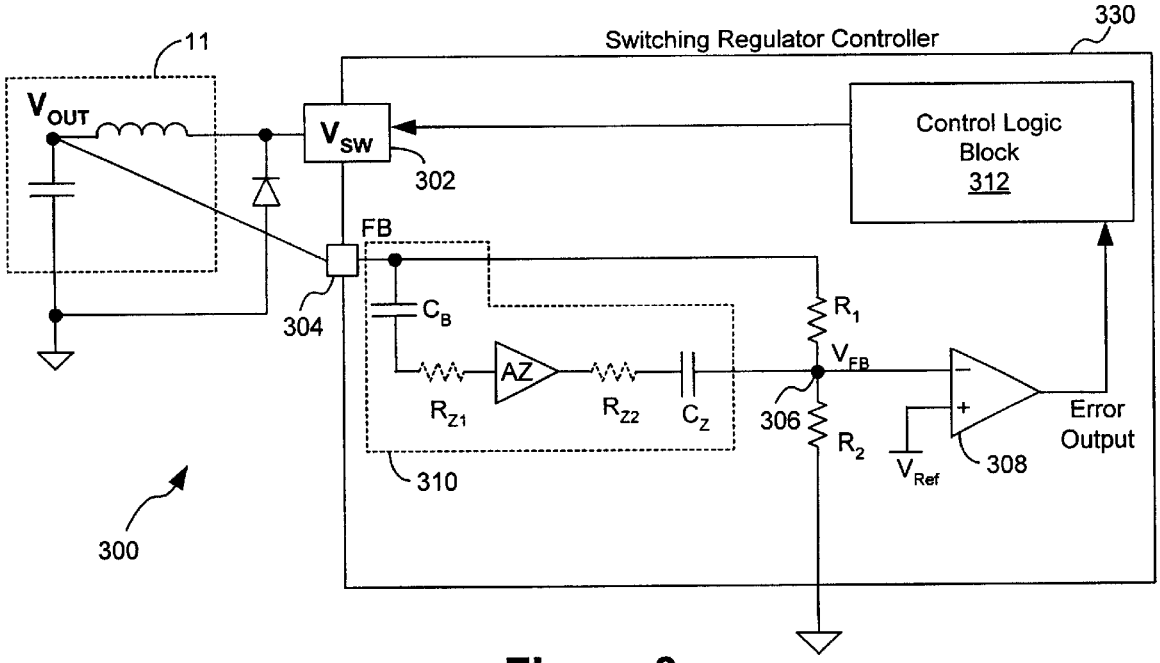
FIG. 3 is a schematic diagram of a switching regulator including a switching regulator controller incorporating a zero generation circuit according to one embodiment of the present invention.

FIG. 3 is a schematic diagram of a switching regulator including a switching regulator controller incorporating a zero generation circuit according to one embodiment of the present invention. The circuitry of switching regulator controller 330 is conventional except for the zero generation circuit 310. Switching regulator controller 330 generates a regulated output voltage $V_{SW}$ on an output terminal 302. The regulated output voltage $V_{SW}$ is coupled to an LC filter circuit 11 to generate an output voltage $V_{OUT}$ having substantially constant magnitudes. Switching regulator 300, constructed using controller 330 and LC circuit 11, forms a closed loop feedback system for regulating output voltage $V_{SW}$ and consequently, the output voltage $V_{OUT}$. The output voltage $V_{OUT}$ from LC filter circuit 11 is fed back to controller 330 on a feedback terminal 304. Typically, the output voltage $V_{OUT}$ is coupled to a voltage divider including resistors $R_1$ and $R_2$ and generating in feedback voltage VFB is coupled to the control circuitry of controller 330. In FIG. 3, the control circuitry of controller 330

In the feedback loop of switching regulator 300, error amplifier 308 has associated with it a pole and a zero. The pole and zero within error amplifier 308 are typically easy to generate because error amplifier 308 includes high impedance nodes. However, it is difficult to generate more than one pole or zero within error amplifier 308. On the other hand, LC filter circuit 11 introduces two poles to the feedback loop of switching regulator 300 which need to be compensated. In the present embodiment, a zero generation circuit 310 is incorporated in controller 330 to introduce a zero to the feedback loop of switching regulator 300, in addition to the zero generated by the error amplifier. Zero generation circuit 310 functions to ensure that the feedback system of switching regulator 300 meets the Nyquist criterion for frequency stability.

According to one embodiment of the present embodiment, zero generation circuit 310 includes a blocking capacitor $C_B$, an amplifier AZ, and a zero capacitor $C_Z$, connected in series between feedback terminal 304 and feedback voltage $V_{FB}$ (node 306). In FIG. 3, circuit 310 is illustrated with a resistor $R_{Z1}$, between capacitor $C_B$ and amplifier AZ and with a resistor $R_{Z2}$ between amplifier AZ and capacitor $C_Z$ drawn in dotted line. Resistors $R_{Z1}$ and $R_{Z2}$ are illustrative only and are used to represent the equivalent input impedance and the equivalent output impedance, respectively, of amplifier AZ. Although resistors $R_{Z1}$ and $R_{Z2}$ are not meant to be actual elements or components in an actual implementation of circuit 310, circuit 310 may include resistors as needed for the implementation of amplifier AZ or for other purposes. As will be explained in more detail below, one embodiment of amplifier AZ includes an input resistor $R_{ZI}$ which, when combined with the gain of the first gain stage in amplifier AZ, creates the input impedance $R_{Z1}$ shown in FIG. 3.

In operation, capacitor $C_B$ receives output voltage $V_{OUT}$ on feedback terminal 304 and functions to block out the DC component of output voltage $V_{OUT}$. Amplifier AZ amplifies the AC component of output voltage $V_{OUT}$ provided by capacitor $C_B$ before coupling the AC signal to zero capacitor $C_Z$. The amplification function performed by amplifier AZ has the effect of amplifying the capacitance of capacitor $C_z$ such that capacitor $C_z$ can be implemented as a smaller capacitor while capable of introducing an effective zero in the feedback system. Furthermore, the AC signal amplification provided by amplifier AZ is also capable of introducing a zero having a wide range of applicability so that the zero is effective over a wide band of frequency. The zero signal generated by capacitor $C_Z$ is summed with feedback voltage $V_{FB}$ at node 306 before the feedback voltage $V_{FB}$ is coupled to the control circuitry of controller 330. In FIG. 3, the summed feedback voltage is coupled to error amplifier 308.

The transfer function from the feedback voltage $V_{FB}$ to the error output (denoted voltage $V_{EOUT}$), in the limiting conditions of $R_1 >> R_{Z2}$, $A_Z >= 1$ and $r \sim 1$, is given as follows:

$$\frac{V_{FB}}{V_{EOUT}} \approx \frac{1}{r}\frac{(A_Z * C_Z * R_1 * s + 1)}{((R_1/r) * C_Z * s + 1)}, \quad (1)$$

where $A_Z$ is the gain of amplifier AZ, s is the complex frequency of the Laplace transform and r is given as:

$$r = \frac{R_1}{R_2} + 1. \quad (2)$$

Equation (1) above yields a pole and a zero angular frequency as follows:

$$\omega_Z = 1/A_Z * R_1 * C_Z, \text{ and} \quad (3)$$

$$\omega_P = 1/(R_1/r) * C_Z. \quad (4)$$

As can be seen from equation (3) above, resistor $R_1$ of the voltage divider of controller 330 provides the resistive load to capacitor $C_Z$ and amplifier AZ for adding a zero in the feedback system. On the other hand, while in equation (4), both resistors $R_1$ and $R_2$ are used to provide a resistive load for introducing the pole of zero generation circuit 310, resistor $R_2$ is not critical for the placement of the pole and can be omitted in other embodiments of the present invention. When resistor $R_2$ is omitted (that is, resistance of resistor $R_2$ is infinite), the factor r has a value of 1 (equation 2) and the angular frequency of the pole, $\omega_p$, depends only on the resistive load of $R_1$.

The ratio of pole angular frequency (equation 4 above) to the zero angular frequency (equation 3 above) is given as follows:

$$\frac{\omega_P}{\omega_Z} = A_Z * r. \quad (5)$$

By adjusting the gain $A_Z$ of amplifier AZ, a very effective and wide band zero for pole cancellation can be generated in the feedback system of switching regulator 300. Referring to equation (5) above, in a conventional feedback system without any "zero" amplification, i. e., when the gain $A_Z$ is equal to 1, the ratio of the pole to zero angular frequency is equal to r and is approximately 2. On the other hand, in a feedback system employing zero generation circuit 310, even when amplifier AZ only has a modest gain of 10, a pole-to-zero frequency ratio of 20 can be obtained. Thus, the zero generation circuit of the present invention is effective in generating a zero with a much broader effective range than that can be obtained with the conventional compensation techniques.

Figure 1:
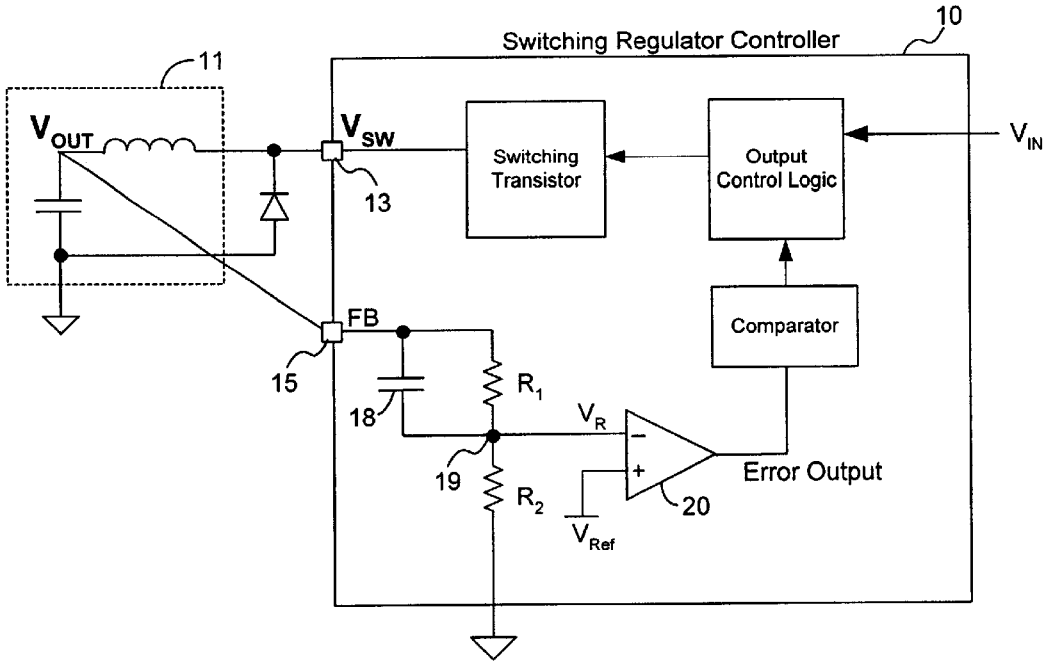
Figure 1 (Prior Art)
FIG. 1 is a schematic diagram of a conventional switching regulator including a zero capacitor for compensation.
Figure 2A:
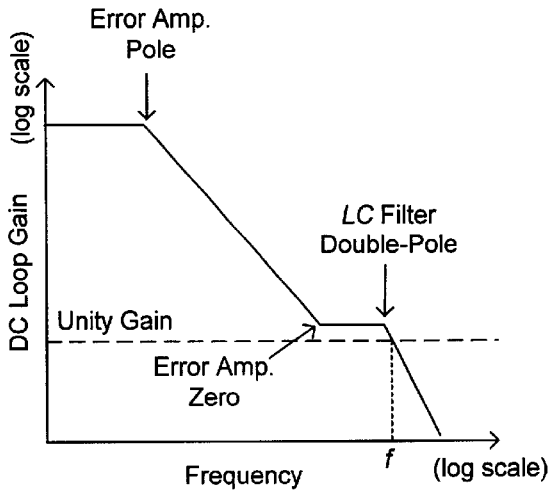
FIG. 2*a* is a loop gain vs. frequency plot for a conventional feedback system in a switching regulator without zero compensation.
Figure 2B:
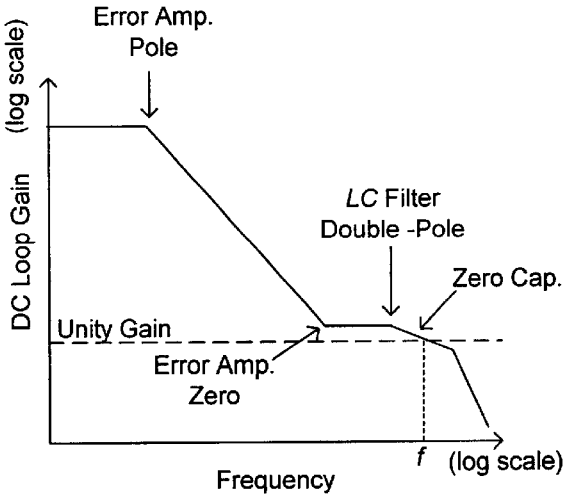
FIG. 2*b* is a loop gain vs. frequency plot for a feedback system in a switching regulator including a zero capacitor for compensation.
Figure 4:
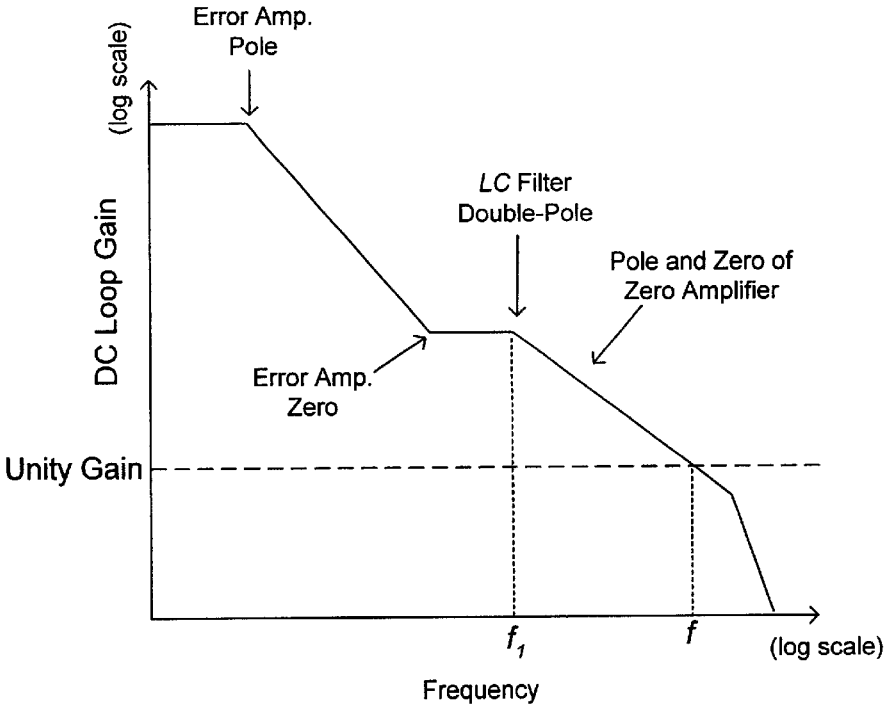
FIG. 4 is a loop gain vs. frequency plot for the feedback system of the switching regulator in FIG. 3.

FIG. 4 is a loop gain vs. frequency plot (in log scale) for the feedback system of the switching regulator of FIG. 3. FIG. 4 illustrates the effect on the loop gain vs. frequency behavior of switching regulator 300 after zero generation circuit 310 introduces a zero in the feedback system of the switching regulator. Referring to FIG. 4, the pole and zero of error amplifier 308 first diminishes the low frequency loop gain of switching regulator 300. At frequency $f_1$, the double-pole of LC filter circuit 11 takes effect. At high frequency, the zero introduced by zero generation circuit 310 (also called the "amplified zero") takes effect. If the onset of the effect of the amplified zero is perfectly matched to the position of double-pole LC filter circuit 11, then the amplified zero will cancel out the effect of one of the double poles. As shown in FIG. 4, the zero-pole pair of the amplified zero is spread much further apart in frequency range than that of the conventional single zero capacitor compensation circuit as shown in FIG. 2*b*. The wide-range spacing of the zero-pole pair of circuit 310 allows for a wider design latitude either for optimizing compensation or for increasing loop gain. Zero generation circuit 310 of the present invention amplifies the effect of the zero of zero capacitor $C_Z$. The action of amplifier AZ introduces a zero having a wide range of effectiveness. Therefore, the placement of the zero in the feedback system is not as critical as in conventional systems. Consequently, zero generation circuit 310 has more tolerance for variations in capacitance values of capacitor $C_Z$. Zero generation circuit 310 improves the overall performance of switching regulator 300.

Figure 5:
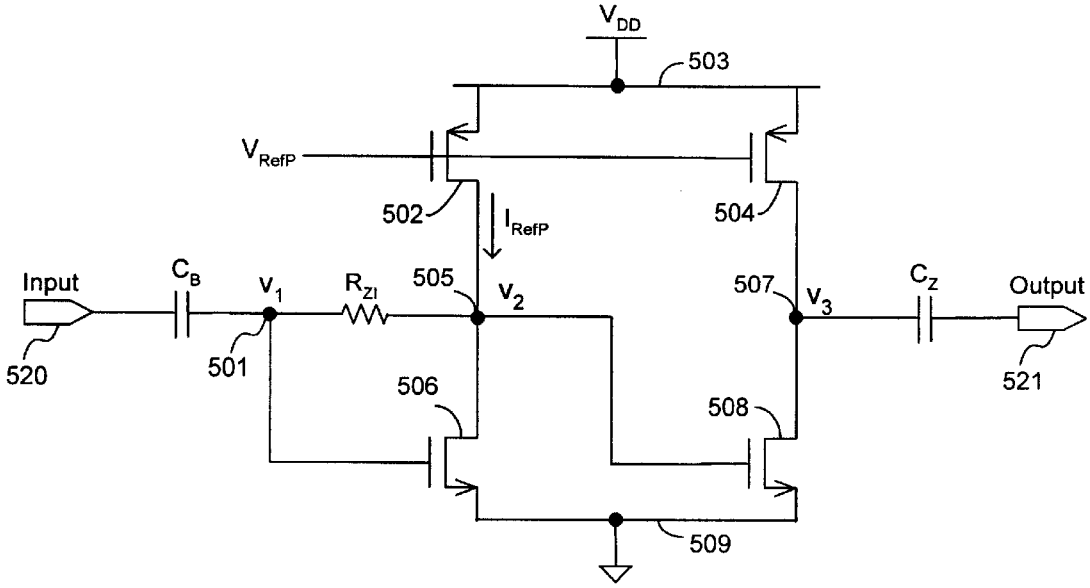
FIG. 5 is a circuit diagram of a zero generation circuit implemented using CMOS devices according to one embodiment of the present invention.

Amplifier AZ of zero generation circuit 310 is an open loop amplifier and can be implemented as any conventional gain stages known in the art. FIG. 5 is a circuit diagram of a zero generation circuit implemented using CMOS devices according to one embodiment of the present invention. Capacitors $C_B$ and $C_Z$ can be implemented as any conventional capacitor structures and in the present embodiment, capacitors $C_B$ and $C_Z$ are MOS capacitors. Capacitor $C_Z$ can have a capacitance value between 1 to 5 picofarads while capacitor $C_B$ has a capacitance value about one-fifth of capacitor $C_Z$. As described above, capacitor $C_B$ functions to block out the DC component of the output voltage $V_{OUT}$ presented at the circuit input node 520. Thus, the voltage $V_1$ at the other side of capacitor $C_B$ (node 501) is the AC component of the output voltage $V_{OUT}$. In the present embodiment, amplifier AZ is implemented as a two-stage gain block with self-biasing capability. The first gain stage includes a resistor $R_{ZI}$ coupled between nodes 501 and 505 and an NMOS transistor 506 biased by a current mirror. Resistor $R_{ZI}$ and the gain of the first gain stage create the effective input impedance $R_{Z1}$ of amplifier AZ. Resistor $R_{Z1}$ can be implemented as a diffused resistor or a polysilicon resistor. In the present embodiment, resistor $R_{ZI}$, is a diffused resistor having a resistance value of approximately 400 kΩ. The current mirror of the first gain stage is implemented by PMOS transistor 502. The gate terminal of transistor 502 is coupled to a reference voltage $V_{Refp}$ for generating a reference current $I_{refp}$ at the drain terminal (node 505) of transistor 502. The source terminal of transistor 502 is coupled to a power supply terminal 503 providing a supply voltage $V_{DD}$. NMOS transistor 506 has its gate terminal connected to node 501 and its drain and source terminals connected between node 505 and a ground node 509. Thus, transistor 506 amplifies the voltage $V_1$, and generates an output voltage $V_2$ at node 505. The second gain stage of amplifier AZ includes an NMOS transistor 508 biased by a current mirror including a PMOS transistor 504. PMOS transistor 504 is connected in an analogous manner as PMOS transistor 502 and generates a reference current $I_{refp}$ at the drain terminal (node 507) of transistor 504. NMOS transistor 508 has its gate terminal coupled to node 505 and amplifies the voltage $V_2$ to provide an output voltage $V_3$ at output node 507. The amplified voltage $V_3$ is coupled to zero capacitor $C_Z$. The action of amplifier voltage $V_3$ and zero capacitor $C_Z$ introduces a zero at a circuit output node 521 having more effectiveness than a zero introduced by conventional compensation circuits. In the present embodiment, PMOS transistors 502 and 504 are of the same sizes while NMOS transistors 506 and 508 are also of the same sizes. In one embodiment, PMOS transistors 502 and 504 each has a width of 20 μm and a length of 3μm. On the other hand, NMOS transistors 506 and 508 each has a width of 6 μm and a length of 2 μm.

The zero generation circuit of the present invention achieves advantages not obtainable in conventional compensation circuits. First, the zero generation circuit utilizes common circuit components and is simple to implement. Contrary to conventional compensation techniques where a closed loop amplifier is used to set the proper gain and phase for the zero function, the zero generation circuit of the present invention simply modulates the location or placement of the zero generated by a zero capacitor. When applied in a switching regulator controller, the zero generation circuit of the present invention is connected to the voltage divider already present in the controller and requires little modification of the overall controller design. The circuit of the present invention avoids adding complex and space consuming compensation circuits to the switching regulator controller as is done the prior art. Second, the zero generation circuit is small in size and thus, is cost effective to incorporate in any linear circuits. Because the capacitance of zero capacitor $C_Z$ is amplified by the action of amplifier AZ, a small capacitor $C_Z$ can be used, resulting in a smaller circuit area in implementation. Through the use of CMOS devices and an open loop amplifier AZ, the zero generation circuit can be operated at very high frequency. Furthermore, the zero generated in the zero generation circuit of the present invention has effectiveness over a wide range of frequencies and thus the circuit can tolerate variations in manufacturing processes and fluctuations in the load impedance.

Figure 6:
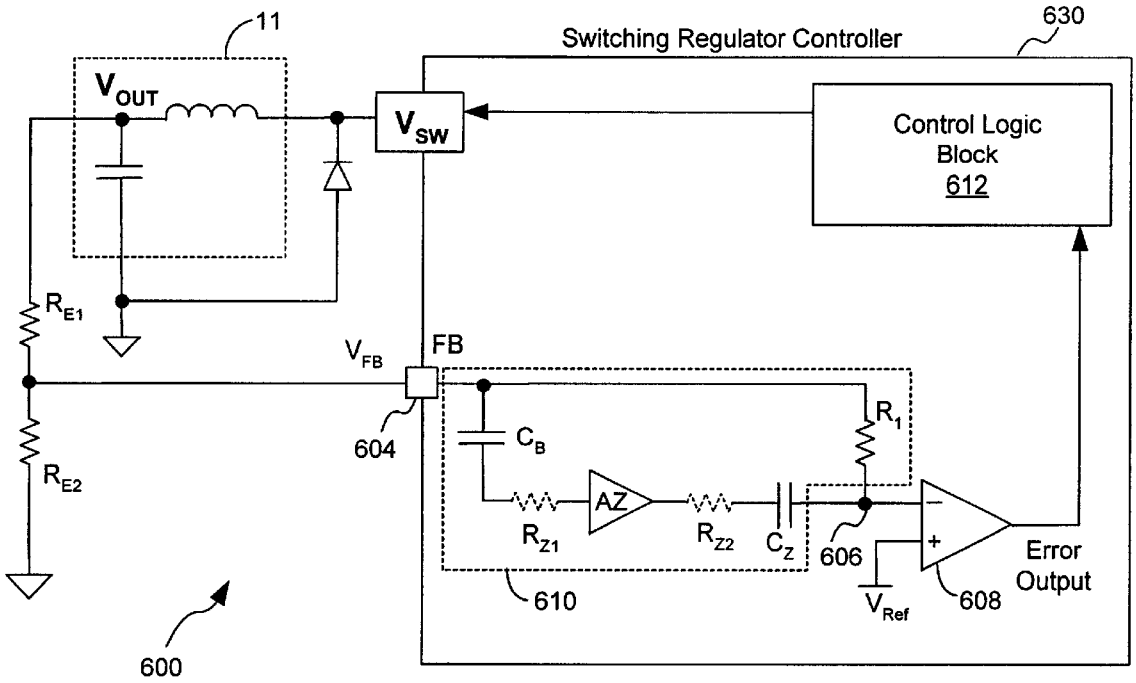
FIG. 6 is a schematic diagram of a switching regulator controller incorporating a zero generation circuit according to another embodiment of the present invention.

In the above embodiment, the zero generation circuit is incorporated in a controller for a fixed switching regulator having an internal voltage divider. As mentioned above, resistor $R_1$ of the voltage divider in controller 330 is used to provide a resistive load to zero generation circuit 310 for introducing an effective zero at node 306. In another embodiment of the present invention, the zero generation circuit of the present invention can also be incorporated in a switching regulator controller for an adjustable switching regulator as illustrated in FIG. 6. Referring to FIG. 6, in an adjustable switching regulator 600, an external voltage divider, including resistors $R_{E1}$, and $R_{E2}$, are used for stepping down the output voltage $V_{OUT}$. The output of the voltage divider of resistors $R_{E1}$, and $R_{E2}$ generates the feedback voltage $V_{FB}$ to be coupled to switching regulator controller 630 on a feedback terminal 604 to form the feedback loop for regulating the output voltage $V_{SW}$. In conventional switching regulator controllers, the feedback voltage $V_{FB}$ is coupled directly to error amplifier 608. However, in accordance with the present embodiment, a zero generation circuit 610 is incorporated into switching regulator controller 630 to generate an effective zero for compensating the double-pole of the LC filter circuit in the feedback system of adjustable switching regulator 600. In switching regulator controller 630, zero generation circuit 610 is coupled between feedback terminal 604 and a node 606 which is the inverting input terminal of error amplifier 608. The structure and operation of zero generation circuit 610 is the same as circuit 310 described above. Basically, capacitor $C_B$ blocks out the DC components of the feedback voltage $V_{FB}$ and amplifier AZ amplifies the AC components of the feedback voltage and couples the amplified voltage signal to zero capacitor $C_Z$. In the case of the adjustable switching regulator, zero generation circuit 610 further includes a resistor $R_1$ connected in parallel to the capacitors and amplifier circuit elements of the zero generation circuit (i. e. between node 604 and node 606). Resistor $R_1$ is used to provide a resistive load to zero generation circuit 610 for introducing an effective zero at node 606. In the present embodiment, the resistance of resistor $R_1$ is between 100 k to 200 k ohms. In one embodiment, resistor $R_1$ of circuit 610 is the same resistor $R_1$ in the voltage divider of switching regulator controller 330 of fixed switching regulator 300. Thus, controller 630 for an adjustable switching regulator can be built using the same circuit design as controller 330 for a fixed switching regulator except that, for controller 630, resistor $R_2$ of the voltage divider of controller 330 is disconnected from node 606. Zero generation circuit 610 generates a wide band zero for effective pole-cancellation in the feedback system of switching regulator 600 and ensures that the switching regulator can achieve frequency stability in operation.

The above detailed descriptions are provided to illustrate specific embodiments of the present invention and are not intended to be limiting. Numerous modifications and variations within the scope of the present invention are possible.

For example, while the above descriptions describe incorporating the zero generating circuit of the present invention in a switching regulator controller, the zero generating circuit of the present invention can be incorporated in any linear circuits being operated in a closed loop feedback system to ensure frequency stability. Also, while the implementation of the zero generation circuit has been described using CMOS devices, the circuit can also be implemented using bipolar devices to provide the same frequency stabilizing result. Lastly, while in the present descriptions, the voltage divider of controller 330 includes two resistors $R_1$ and $R_2$, a person of ordinary skill in the art would appreciate that the voltage divider can be implemented using any numbers of resistors to produce the desired divided voltage. The present invention is defined by the appended claims.

I claim:

1. A compensation circuit for introducing a zero in a first circuit being incorporated in a closed loop feedback system, said first circuit including a first terminal generating a first voltage for said closed loop feedback system, a feedback terminal for receiving a feedback voltage from said closed loop feedback system, said feedback terminal coupling said feedback voltage to an input node in said first circuit, said compensation circuit comprising:

a first capacitor coupled between said feedback terminal of said first circuit and a first node, said first capacitor blocking out the DC component of said feedback voltage;

an amplifier coupled between said first node and a second node;

a second capacitor coupled between said second node and said input node of said first circuit; and a first resistor coupled between said feedback terminal and said input node of said first circuit.

2. The circuit of claim 1, wherein said amplifier amplifies a capacitance of said second capacitor for introducing a zero in said first circuit.

3. The circuit of claim 1, wherein said amplifier is an open loop amplifier.

4. The circuit of claim 1, wherein said amplifier comprises:

a second resistor coupled between said first node and a third node;

a first transistor having a control terminal coupled to said first node, a first current handling terminal coupled to said third node and a second current handling terminal coupled to a first power supply;

a first current mirror having an input terminal coupled to receive a first bias voltage and an output terminal coupled to said third node and providing a first bias current to said first transistor;

a second transistor having a control terminal coupled to said third node, a first current handling terminal coupled to said second node and a second current handling terminal coupled to said first power supply; and a second current mirror having an input terminal coupled to receive said first bias voltage and an output terminal coupled to said second node and providing a second bias current to said second transistor.

5. The circuit of claim 4, wherein said first and second transistors are NMOS transistors.

6. The circuit of claim 4, wherein each of said first and second current mirrors comprises a PMOS transistors having its gate terminal coupled to said first bias voltage, a first current handling terminal providing a bias current and a second current handling terminal coupled to a second power supply.

7. The circuit of claim 6, wherein said first power supply is ground and said second power supply is a positive power supply.

8. The circuit of claim 4, wherein said second resistor is a diffused resistor.

9. The circuit of claim 1, wherein each of said first and second capacitors comprises a diffused lower plate, an insulator, and a conductive material overlaying said insulator as an upper plate.

10. The circuit of claim 1, wherein said second capacitor has a capacitance of about 1 to 5 picofarads and said first capacitor has a capacitance of about one-fifth of said second capacitor.

11. A switching regulator controller circuit comprising:

an output terminal providing a signal corresponding to a regulated output voltage;

a feedback terminal for receiving a feedback voltage corresponding to said regulated output voltage;

a control circuit including an input node coupled to receive a voltage corresponding to said feedback voltage, and an output node generating said signal corresponding to said regulated output voltage and coupling said signal to said output terminal;

a first capacitor coupled between said feedback terminal and a first node, said first capacitor for blocking out the DC component of said feedback voltage;

an amplifier coupled between said first node and a second node;

a second capacitor coupled between said second node and said input node of said control circuit; and a first resistor coupled between said feedback terminal and said input node of said control circuit.

12. The circuit of claim 11, wherein said feedback voltage is a divided voltage of said regulated output voltage.

13. The circuit of claim 11, wherein said feedback voltage is said regulated output voltage and said feedback terminal is coupled to a voltage divider in said switching regulator controller circuit, said first resistor being a part of said voltage divider.

14. The circuit of claim 13, wherein said voltage divider comprises at least two resistors connected in series and provides a first divided feedback voltage to said input node of said control circuit.

15. The circuit of claim 11, wherein said amplifier amplifies a capacitance of said second capacitor for introducing a zero in said switching regulator controller circuit.

16. The circuit of claim 11, wherein said amplifier is an open loop amplifier.

17. The circuit of claim 11, wherein said amplifier comprises:

a second resistor coupled between said first node and a third node;

a first transistor having a control terminal coupled to said first node, a first current handling terminal coupled to said third node and a second current handling terminal coupled to a first power supply;

a first current mirror having an input terminal coupled to receive a first bias voltage and an output terminal coupled to said third node and providing a first bias current to said first transistor;

a second transistor having a control terminal coupled to said third node, a first current handling terminal coupled to said second node and a second current handling terminal coupled to said first power supply; and a second current mirror having an input terminal coupled to receive said first bias voltage and an output terminal coupled to said second node and providing a second bias current to said second transistor.

18. The circuit of claim 17, wherein said first and second transistors are NMOS transistors.

19. The circuit of claim 17, wherein each of said first and second current mirrors comprises a PMOS transistors having its gate terminal coupled to said first bias voltage, a first current handling terminal providing a bias current and a second current handling terminal coupled to a second power supply.

20. The circuit of claim 19, wherein said first power supply is ground and said second power supply is a positive power supply.

21. The circuit of claim 17, wherein said second resistor is a diffused resistor.

22. The circuit of claim 11, wherein each of said first and second capacitors comprises a diffused lower plate, an insulator, and a conductive material overlaying said insulator as an upper plate.

23. The circuit of claim 11, wherein said second capacitor has a capacitance of about 1 to 5 picofarads and said first capacitor has a capacitance of about one-fifth of said second capacitor.

24. The circuit of claim 11, wherein said control circuit comprises:

an error amplifier having a first input terminal coupled to said input node, a second input terminal coupled to a reference voltage and an output terminal providing an output voltage indicative of the difference between a voltage at said first input terminal and said reference voltage at said second input terminal.

25. The circuit of claim 11, wherein said output terminal of said switching regulator controller circuit is coupled to an output filter circuit for generating said regulated output voltage.

26. The circuit of claim 25, wherein said output filter circuit comprises an inductor and a capacitor connected in series between said output terminal and a ground terminal.

27. A method for providing zero compensation in a first circuit incorporated in a closed loop feedback system, said method comprising:

applying a feedback voltage at a first node of said first circuit to a first capacitor;

filtering out the DC component from said feedback voltage using said first capacitor;

amplifying said filtered feedback voltage;

applying said amplified filtered feedback voltage to a second capacitor coupled to a second node of said first circuit;

coupling a resistive load between said first node and said second node; and introducing a zero at said second node in said first circuit as a result of coupling said amplified filtered feedback voltage to said second capacitor.

28. The method of claim 27, wherein said applying said amplified filtered feedback voltage to a second capacitor functions to amplify the capacitance of said second capacitor for introducing a zero for canceling a pole in said closed loop feedback system.

* * * * *

UNITED STATES PATENT AND TRADEMARK OFFICE

CERTIFICATE OF CORRECTION

PATENT NO. : 6,304,067 B1
DATED : October 16, 2001
INVENTOR(S) : Robert S. Wrathall It is certified that error appears in the above-identified patent and that said Letters Patent is hereby corrected as shown below:

Column 4,
Line 27, delete "resent" and substitute -- present --.
Line 55, delete "magnitudes" and substitute -- magnitude --.
Line 62, delete "in feedback voltage VFB is coupled to the control circuitry of controller 330. In FIG. 3, the control circuitry of controller 330" and substitute --a feedback voltage $V_{FB}$ at a divider output node 306. The voltage divider functions to step down the output voltage $V_{OUT}$ to a reference voltage level $V_{Ref}$ at output node 306. The stepped down feedback voltage VFB is coupled to the control circuitry of controller 330. In FIG. 3, the control circuitry of controller 330 is illustrated as including an error amplifier 308 and a control logic block 312. The feedback voltage $V_{FB}$ is coupled to the inverting terminal of error amplifier 308. A reference voltage $V_{Ref}$ is coupled to the non-inverting input terminal of error amplifier 308. The error output generated by error amplifier 308 is coupled to control logic block 312 for regulating the regulated output voltage $V_{SW}$ on node 302. Control logic block 312 is conventional and numerous implementations are possible. Typically, control logic block 312 includes a logic control circuit and one or more switching transistors. If controller 330 is operating in a PWM mode, control logic block 312 may further include a PWM comparator to which the error output is coupled. The schematic diagram of Figure 3 is simplified to better illustrate the principles of the present invention. It is understood by one skilled in the art that, in actual implementation, switching regulator controller 330 may include additional terminals and circuitry for the specific application.--.

Signed and Sealed this

Eleventh Day of November, 2003

JAMES E. ROGAN
*Director of the United States Patent and Trademark Office*